US006260470B1

(12) United States Patent
Mieger

(10) Patent No.: US 6,260,470 B1
(45) Date of Patent: Jul. 17, 2001

(54) HYDRAULIC PISTON-CYLINDER-UNIT FOR A SLEWING DRIVE

(76) Inventor: Rolf Mieger, Fellheimer Weg 23, Kirchdorf/UO D-88457 (DE)

( * ) Notice: Subject to any disclaimer, the term of this patent is extended or adjusted under 35 U.S.C. 154(b) by 0 days.

(21) Appl. No.: 09/301,719

(22) Filed: Apr. 29, 1999

(30) Foreign Application Priority Data

May 12, 1998 (DE) ..... 298 08 647 U
Jul. 24, 1998 (DE) ..... 298 13 241 U

(51) Int. Cl.[7] ..... F01B 9/00
(52) U.S. Cl. ..... 92/138; 92/161
(58) Field of Search ..... 92/138, 140, 161, 92/169.1, 88; 37/406

(56) References Cited

U.S. PATENT DOCUMENTS 1,604,548 * 10/1926 Dapron ..... 92/138
3,503,144 3/1970 Stewart ..... 37/117.5

FOREIGN PATENT DOCUMENTS 94 07 859 10/1994 (DE) .
29621253 U1 * 5/1997 (DE) .
296 21 253 7/1997 (DE) .
0 033 966 8/1981 (EP) .
0 577 430 1/1994 (EP) .
1468472 4/1967 (FR) .
2 499 123 8/1982 (FR) .
2 537 624 6/1984 (FR) .

* cited by examiner

*Primary Examiner*—F. Daniel Lopez
*Assistant Examiner*—Thomas E. Lazo
(74) *Attorney, Agent, or Firm*—Jacobson Holman PLLC

(57) ABSTRACT

The invention relates to a hydraulic piston-cylinder-unit (10) for a slewing drive with at least one piston, which can be slid in a cylinder and exhibits fastening means, by means of which the piston can be connected in such a manner to a coupling rod that the working tool can be swung by means of a movement of the piston. In accordance with the invention the cylinder exhibits fastening means, by means of which the cylinder can be connected to the working tool or to a carrier of the slewing drive.

20 Claims, 6 Drawing Sheets

HYDRAULIC PISTON-CYLINDER-UNIT FOR A SLEWING DRIVE

BACKGROUND OF THE INVENTION

1. Field of the Invention

The present invention relates to a hydraulic piston-cylinder-unit for a slewing drive, especially to swing working tools, with at least one piston, which can be slid in a cylinder and exhibits fastening means, by means of which the piston can be connected in such a manner to a coupling rod that the working tool can be swung by means of a movement of the piston.

2. Description of the Related Art

Hydraulic piston-cylinder-units are widely used to drive working tools, especially to swing backhoe and face shovels of dredgers. The DE-U-94 07 859 discloses a hydraulically driven dredging shovel, which can be arranged so as to swing on a carrier, arranged on the front end of the boom of a dredger. The swinging motion of the shovel is induced by means of a piston-cylinder-unit, which is arranged in a carrier, located in the upper rim area of the shovel. The carrier is connected to a coupling rod, with which the piston-cylinder-unit engages. The carrier is preferably shaped tubularly and contains the cylinder of the piston-cylinder-unit. Furthermore, the DE-U-296 21 253 discloses a slewing adapter to swing a tool, such as a dredging shovel, wherein the piston-cylinder-unit is envisaged in a coupling mechanism, which can be swung relative to the carrier of the construction machine. In this case, too, the piston-cylinder-unit is located preferably in a tubular carrier.

The end areas of the coupling rod are connected to the carrier of the construction machine and to the piston-cylinder-unit so as to swing. The connection to the piston-cylinder-unit is accomplished usually by means of an extension piece, which is mounted on the piston and which projects beyond the carrier, containing the piston-cylinder-unit.

Such an arrangement has the disadvantage that the extension piece cannot be mounted in principle until after the piston-cylinder-unit has been slid into the carrier. The result is a relatively low degree of prefabrication of the slewing drive, since the extension piece cannot be attached to the piston rod before the cylinder has been installed in a carrier.

SUMMARY OF THE INVENTION

The object of the present invention is to improve a piston-cylinder-unit for a slewing drive to the extent that it is easier to mount.

This problem is largely solved by a piston-cylinder-unit of the aforementioned kind in that the cylinder exhibits fastening means, by means of which the cylinder can be connected to the working tool or to a carrier of the slewing drive. The advantage herein lies in the fact that the extension piece can be mounted, for example, by screwing or welding before the piston-cylinder-unit is attached. The reason for this lies in the fact that, according to the invention, the cylinder of the piston-cylinder-unit is not slid into a carrier, but rather it itself functions as the carrier of the piston-cylinder-unit. This goal is reached in that the cylinder exhibits fastening means, by means of which it can be attached to the working tool or also to the carrier of the slewing drive.

Thus, it is no longer necessary to slide the cylinder into a carrier; and correspondingly it is possible to prefabricate the piston with extension pieces.

Furthermore, there are cost advantages in production, since the piston rod can be produced, according to the invention, as one piece with the welded extension piece. In addition it is possible to make the effective lengths smaller than in prior art slewing drives, since the narrower design of the welded extension piece makes it possible to use a correspondingly narrower cylinder. Another important advantage is the faster assembly and disassembly or the easy replacement of the piston-cylinder-unit.

A preferred embodiment of the present invention provides that the cylinder of the hydraulic piston-cylinder-unit is designed as a twin plunger cylinder. In this case a piston rod is used whose end regions can be moved in one of the end regions of the cylinder.

The chambers of the twin plunger cylinder that are provided at both faces of the piston and are pressure-driven can exhibit different diameters. The resulting advantage lies in the fact that forces can be introduced that vary with the piston's direction of motion in accordance with the different areas; and thus different velocities of the pistons can be realized. Such an arrangement is especially advantageous when the piston-cylinder-unit according to the invention is used with a grabber, since in this case different velocities are often necessary when opening or closing the grabber.

Another embodiment of the present invention provides that the fastening means of the piston are designed as an extension piece, which projects beyond the cylinder and to which the coupling rod can be attached so as to swing. The piston's movement in the cylinder leads to a corresponding movement of the extension piece connected to the piston, thus resulting in a corresponding swinging of the piston-cylinder-unit or a workpiece fastened thereto when the piston moves owing to the coupling rod, hinged to the extension piece.

In addition, the cylinder may exhibit one or several slotted recesses, through which the extension piece extends. The extension piece exhibits a cover element, by means of which the recess can be covered in all positions of the piston. The cover element can be screwed or also welded to the extension piece and serves primarily to prevent the piston-cylinder-unit from becoming dirty. In addition, it prevents an inadvertent engagement with the slotted recess of the cylinder.

According to a preferred design of the present invention, the extension piece is screwed or welded to the piston. One advantage of the welded design lies in the fact that a narrow extension piece can be used that in turn necessitates a narrow cylinder. Another advantage of welding lies in cost reduction. In both cases (screwed or welded) it is possible to attach the extension piece to the piston prior to installation of the piston-cylinder-unit. Especially in this case the resulting advantage is also that the piston-cylinder-unit of the invention can be quicky assembled and disassembled; and, when the requirements change, it can be easily replaced with a piston-cylinder-unit of a different design.

According to a preferred embodiment of the present invention, each opposite side of the piston exhibits one extension piece each, which extends radially from said piston. The resulting advantage lies in the fact that special tools, for example with several components, to be moved synchronously, such as grabbers, can be driven by means of the piston-cylinder-unit of the invention.

Another embodiment of the present invention provides that the piston of the hydraulic piston-cylinder-unit exhibits a cross borehole. In this case the coupling rods of a slewing drive are connected to the piston of the piston-cylinder-unit according to the configuration of the borehole.

Another embodiment of the present invention provides that the fastening element of the cylinder comprises straps, which have boreholes to mount the cylinder. In this case the straps can extend radially from the cylinder or can be configured at any other arbitrary position, for example in the bottom region of the cylinder. The straps are welded preferably to the outer jacket of the cylinder. The boreholes in the straps serve to connect the piston-cylinder-unit to a tool, for example to a shovel, or also to the carrier of the slewing drive.

It is especially advantageous if the cylinder of the hydraulic piston-cylinder-unit of the invention consists of two end members and at least one center member, which is connected to the end members so as to disconnect. Such a design of the cylinder offers the possibility of being able to select freely the length of the cylinder and thus also the slewing angle through the appropriate choice of the center member. The center member is flanged preferably to the end members.

The center member can exhibit the slotted recess, whose purpose serves the passing through of the extension piece of the piston.

Another embodiment of the present invention provides that the center member exhibits a strap, by means of which the piston-cylinder-unit can be swung in the carrier.

BRIEF DESCRIPTION OF THE DRAWINGS

Other details and advantages of the invention are explained in detail with reference to the embodiments depicted in the drawings.

DETAILED DESCRIPTION OF THE PREFERRED EMBODIMENTS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Figure 1A:
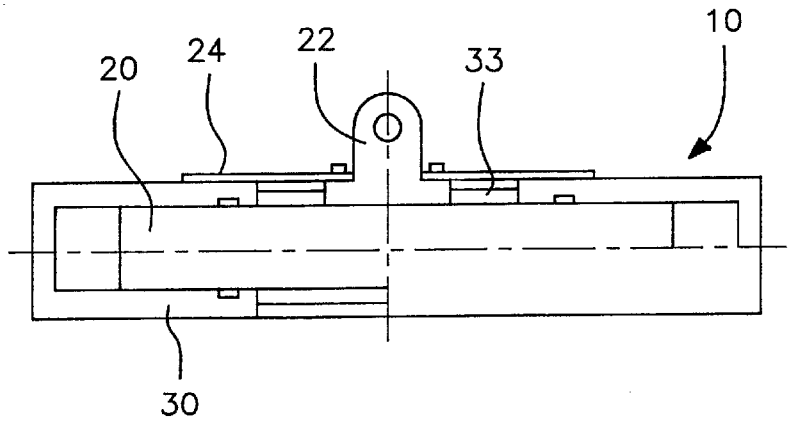
FIG. 1A is a front view, which is a sectional view in part, of one embodiment of the piston-cylinder-unit with an extension piece.

FIG. 1A is a front view, which is a sectional view in part, and a side view of a first embodiment of the piston-cylinder-unit 10 of the invention, where a piston 20 can be slid in the twin plunger cylinder 30. The top side of the twin plunger cylinder 30 exhibits a slotted recess 33, through which the extension piece 22 extends.

The extension piece 22 is screwed to the piston 20. Said extension piece exhibits a borehole to receive a coupling rod, which is attached so as to swivel.

Furthermore, the extension piece 22 is connected to the cover element 24, which is designed as a sheet metal strip. Thus, an unintentional engagement with the slotted recess 33 is prevented; and in all positions of the piston 20 dirt is effectively prevented from getting into the piston-cylinder-unit 10.

Figure 1B:
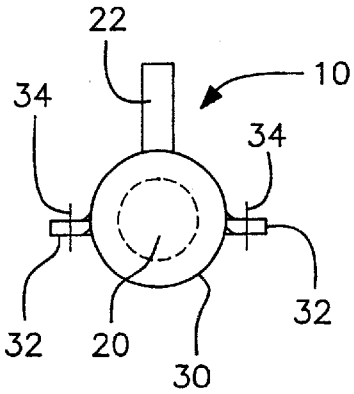
FIG. 1B is a side view of the embodiment of FIG. 1A.

FIG. 1B is a side view of the straps 32, which are arranged on the outside of the twin plunger cylinder 30 and by means of which the piston-cylinder-unit 10 or the twin plunger cylinder 30 can be fastened. The straps 32 have vertical boreholes 34. The straps 32 are welded to the twin plunger cylinder 30.

Figure 2A:
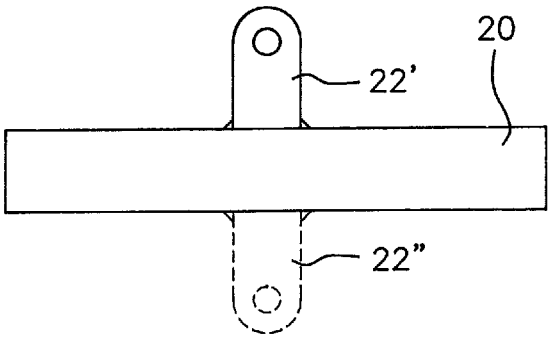
FIG. 2A is a front view of an embodiment of the piston rod with two opposite extension pieces, which extend radially.
Figure 2B:
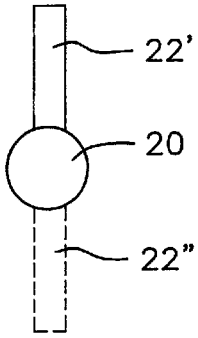
FIG. 2B is a side view of the embodiment of FIG. 2A.

FIG. 2A is a front view and FIG. 2B is a side view of another embodiment of the piston rod 20, which exhibits two opposite extension pieces 22' and 22", which extend radially from the piston 20. Each of the extension pieces 22' and 22" exhibits a borehole to receive a coupling rod. Such a piston rod 20 is provided, for example, for the special application with synchronously moved tools.

Figure 3A:
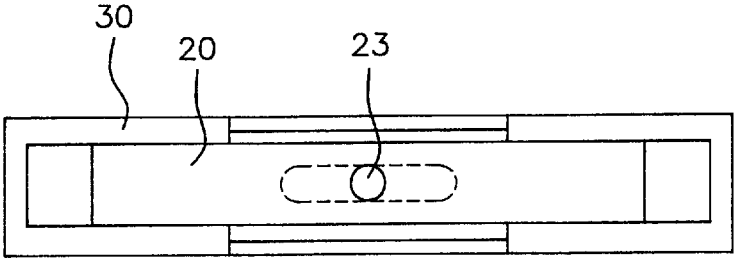
FIG. 3A is a longitudinal view of one embodiment of the piston-cylinder-unit with cross borehole.
Figure 3B:
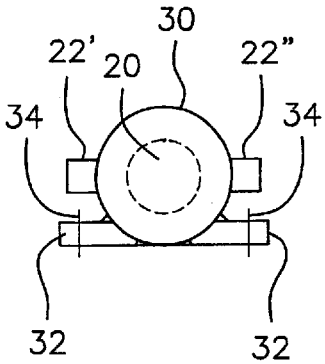
FIG. 3B is a side view of the embodiment of FIG. 3A.

FIGS. 3A and 3B depict another embodiment of a piston-cylinder-unit 10, in which the piston rod 20 can be slid in the twin plunger cylinder 30. As evident from FIG. 3B, the piston 20 has two horizontally extending extension pieces 22' and 22", through which the borehole 23 extends. The bottom region of the twin plunger cylinder 30 has straps 32 to fasten the piston-cylinder-unit 10, each of said straps exhibits a vertical borehole 34.

Figure 4A:
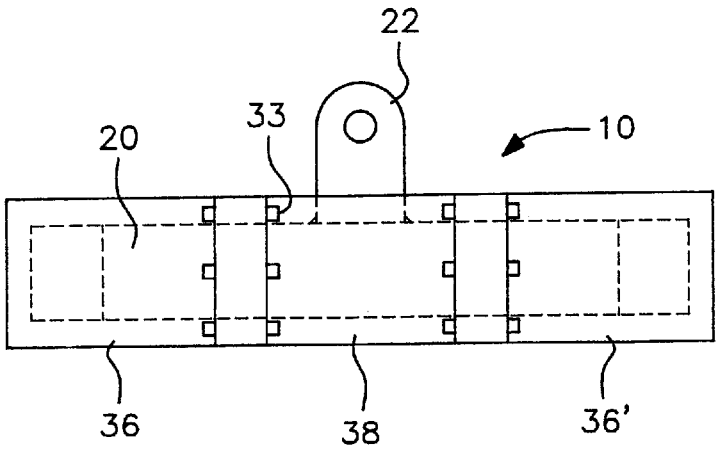
FIG. 4A is a front view of one embodiment of the piston-cylinder-unit with flanged center member.
Figure 4B:
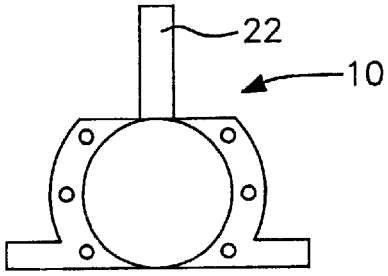
FIG. 4B is a side view of the embodiment of FIG. 4A.

FIG. 4A is a front view and FIG. 4B is a side view of one embodiment of the piston-cylinder-unit 10 of the invention, where the end members 36, 36' of the twin plunger cylinder 30 are connected together by means of a flanged center member 38. The result is the possibility of making arbitrary adjustments to the length of the cylinder and thus also the slewing angle of the slewing drive through the choice of the center member 38. According to FIGS. 4A and 4B, the piston 20 exhibits an extension piece 22, for which the top side of the center piece has a corresponding recess 33.

Figure 5A:
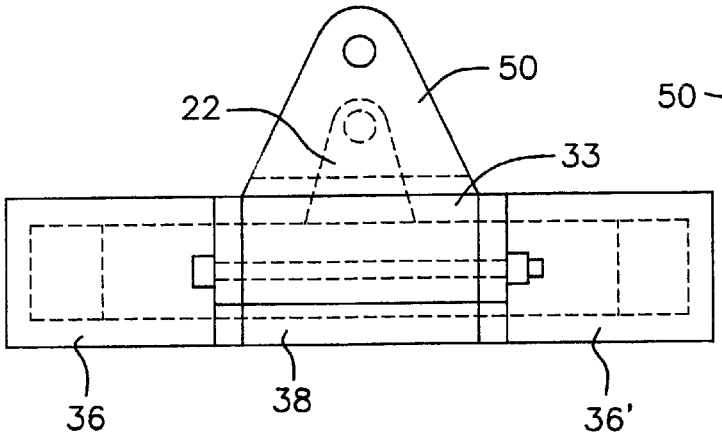
FIG. 5A is a front view of one embodiment of the piston-cylinder-unit with flanged center member, where the center member exhibits a strap to swing the piston-cylinder-unit.
Figure 5B:
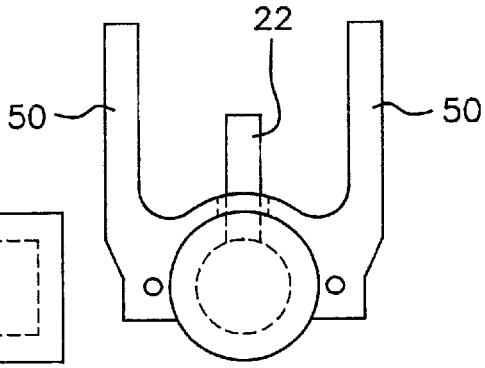
FIG. 5B is a side view of the embodiment of FIG. 5A.

FIGS. 5A and 5B also depict an embodiment, where the end members 36, 36' of the twin plunger cylinder are connected together by means of the center member 38. The flanged center member 38 exhibits the straps 50, which exhibit a borehole and serve to pivot-mount the piston-cylinder-unit or an attached tool to a carrier. As already explained with respect to FIGS. 4A and 4B, the piston rod 20 exhibits an extension piece 22, which extends through a slotted recess 33 of the center piece 38.

Figure 6B:
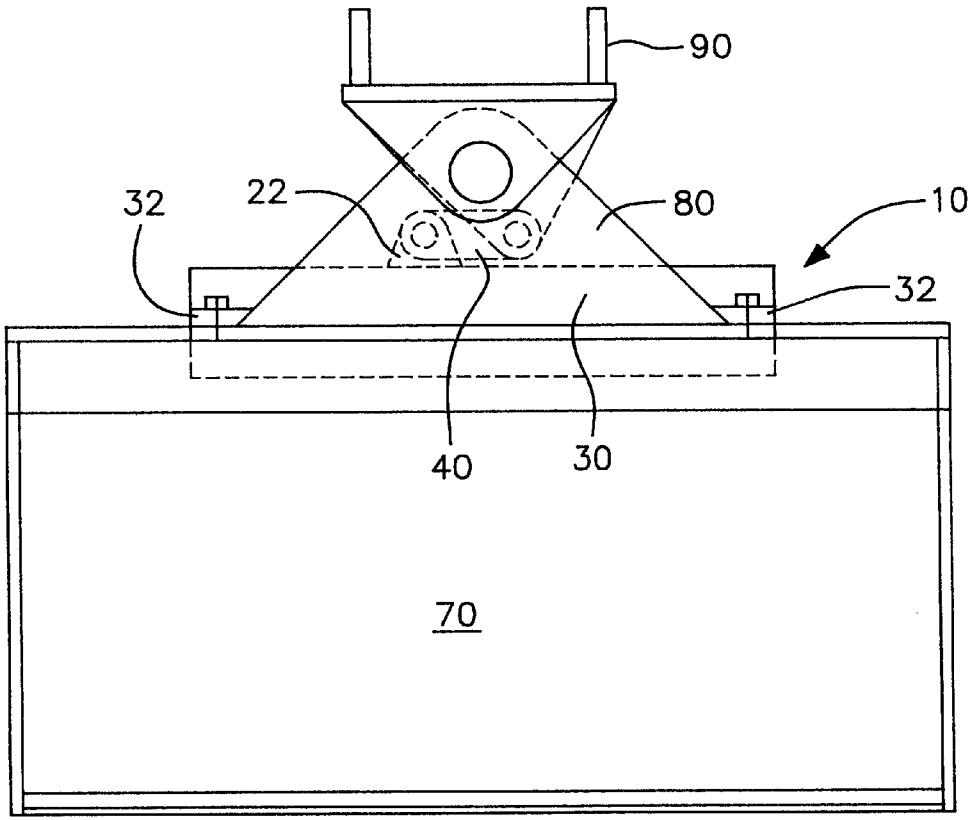
FIG. 6B is a front view of a dredging shovel with the piston-cylinder-unit of the invention according to FIG. 1.
Figure 6A:
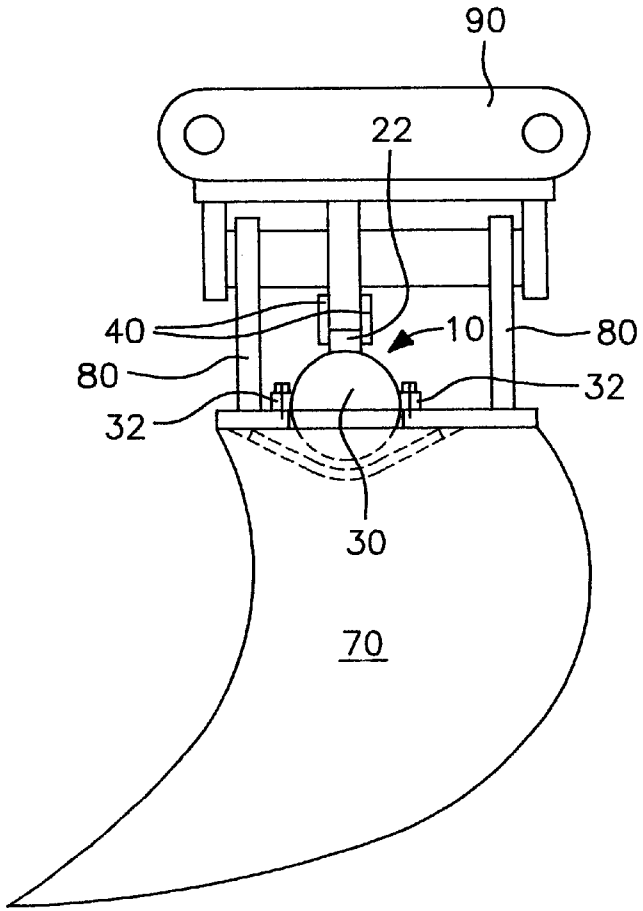
FIG. 6A is a side view of a dredging shovel with the piston-cylinder-unit of the invention according to FIG. 1.

FIG. 6A is a side view and FIG. 6B is a front view of a dredging shovel 70. The dredging shovel 70 is connected by means of the straps 80 to a carrier 90, for example, the dredger boom so as to swing.

The upper region of the dredging shovel 70 of the dredger has the invention's piston-cylinder-unit 10, which is screwed to the dredging shovel 70 by means of the straps 32. The extension piece 22 projects beyond the upper side of the piston-cylinder-unit 10. Said extension piece is connected to the carrier 90 by means of coupling rods 40, which are arranged to the right and left of said extension piece. A movement of the piston (not illustrated) by raising the pressure in the appropriate chamber of the twin plunger cylinder 30 results in a displacement of the extension piece 22, which leads to the dredging shovel 70 being swung relative to the carrier 90 owing to the arrangement of the coupling rod 40.

Figure 7B:
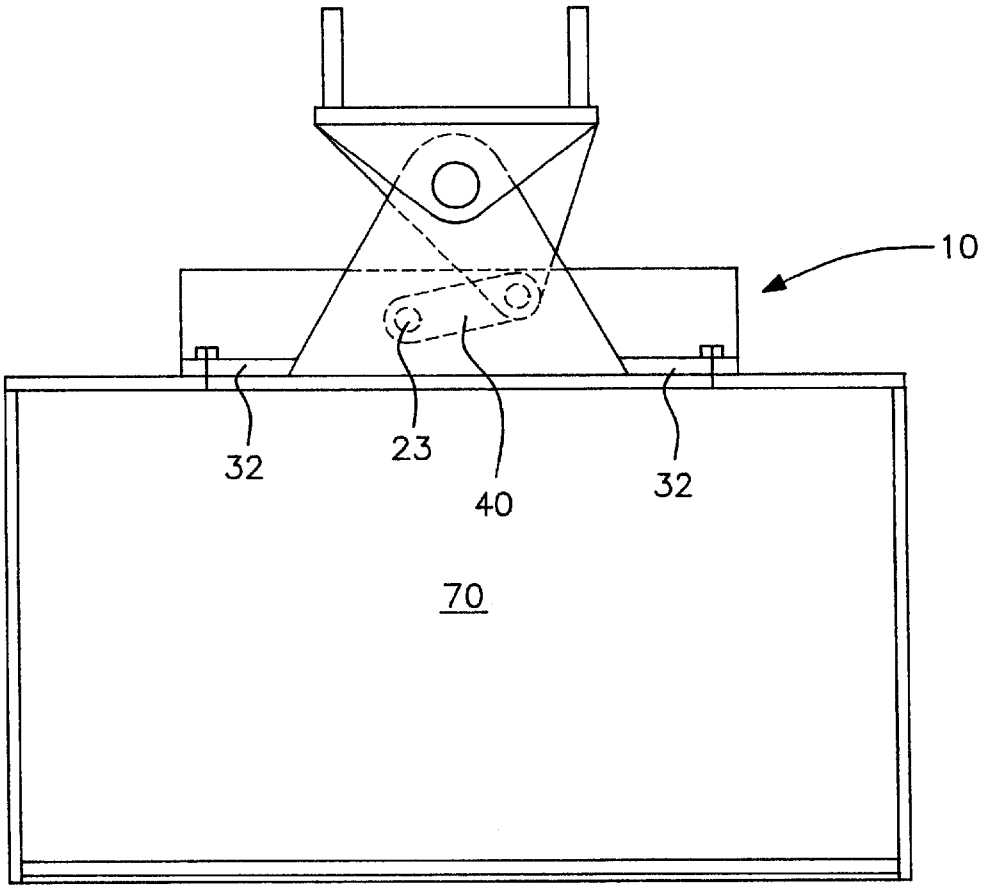
FIG. 7B is a front view of a dredging shovel with the piston-cylinder-unit of the invention according to FIG. 3.
Figure 7A:
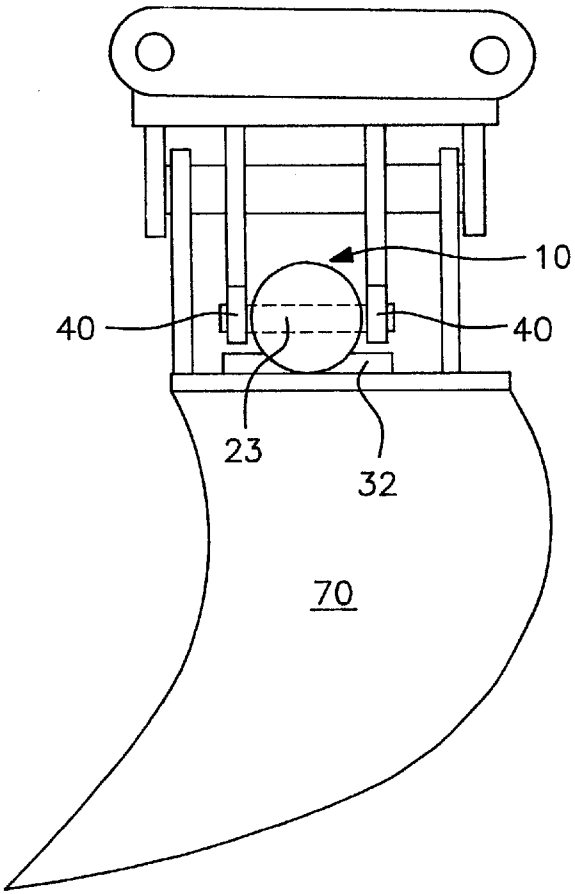
FIG. 7A is a side view of a dredging shovel with the piston-cylinder-unit of the invention according to FIG. 3.

FIGS. 7A and 7B depict an arrangement of a dredging shovel 70 according to FIGS. 6A and 6B, where the embodiment of FIGS. 3A and 3B was used as the piston-cylinder-unit 10. In this case the coupling rods 40 are attached to the extension pieces, which extend laterally from the piston. The coupling rods 40 are connected to the piston of the piston-cylinder-unit 10 so as to swing by means of a bolt, extending through the borehole 23. As already explained in FIGS. 6A and 6B, the piston-cylinder-unit 10 is screwed by means of the straps 32 to said dredging shovel on the upper side of the dredging shovel 70.

Figure 8:
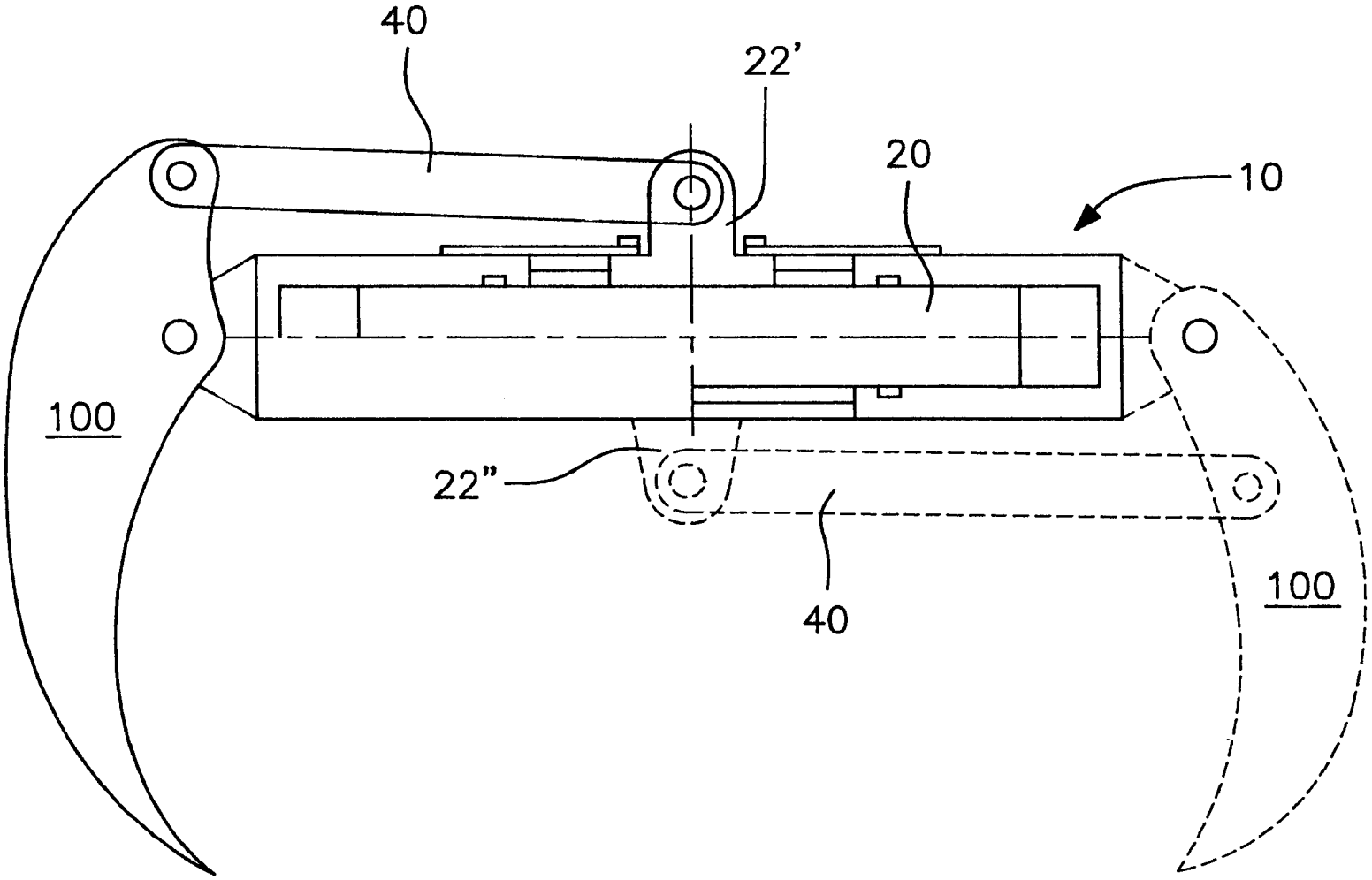
FIG. 8 is a partial sectional front view of a grabber with a piston rod according to FIG. 2.

FIG. 8 depicts another embodiment of the invention, where a piston-cylinder-unit 10 is used, where the piston 20 is designed according to FIGS. 2A and 2B. Thus, the opposing extension pieces 22', 22" extend radially on two sides of the piston. Attached to said extension pieces by means of suitable boreholes are coupling rods 40 in order to drive the grab tongs 100 of a grabbing device synchronously.

Figure 9:
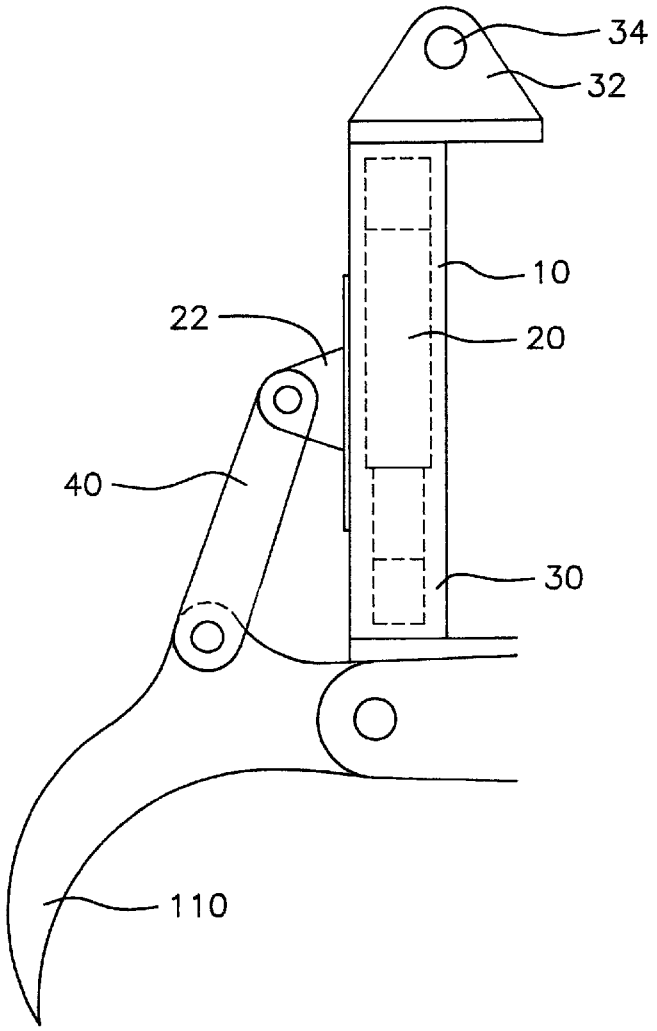
FIG. 9 is a side view of the piston-cylinder-unit of the invention with grabber and FIG. 10 is a cross sectional view of a grabber with several piston rod units.

FIG. 9 is a side view of a grabbing device with a piston-cylinder-unit 10 of the invention. The piston-cylinder-unit 10 comprises the piston 20, which can move in the twin plunger cylinder 30. Said piston exhibits the extension piece 22, which is connected to two coupling rods 40 so as to swing. Furthermore, the half scoop 110 of the grabbing device is attached to the coupling rods 40 so as to swivel.

The top end region of the piston-cylinder-unit 10 exhibits straps 32 as the fastening means; said straps have boreholes 34 to mount the piston-cylinder-unit 10 on a carrier.

Furthermore, FIG. 9 shows that the bottom chamber of the twin plunger cylinder 30 exhibits a smaller diameter and thus a smaller cross sectional area than the chamber, bordering the piston 20 in the top end region of the twin plunger cylinder 30. Different forces and speeds with respect to the up and down motion of the piston 20 and thus opening and closing of the half scoop 110 can be realized as a function of the different cross sectional areas.

Figure 10:
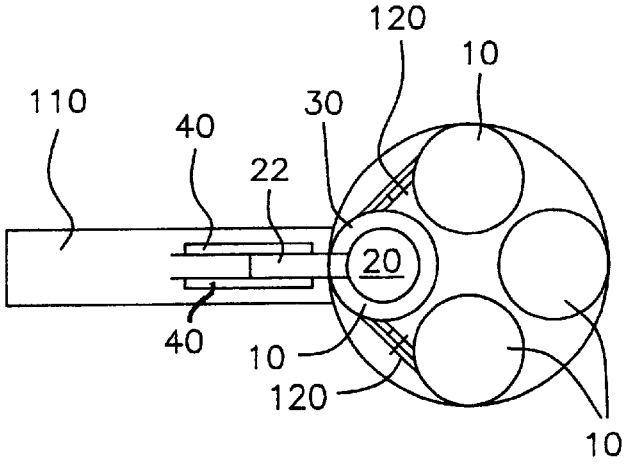

FIG. 10 depicts an arrangement, wherein several piston-cylinder-units 10 of the invention are configured parallel to each other. Each piston-cylinder-unit 10 exhibits a twin plunger cylinder 30, in which the piston 20 can be moved. From said piston extends radially the extension piece 22, which is connected by means of the coupling rods 40 to the half scoop 110 so as to swing. For the sake of clarity the picture in FIG. 10 shows only one piston 20 with extension piece 22 and coupling rods 40 and only one half scoop 110.

Each of the other half scoops (not illustrated) extends radially and outwardly from the individual piston-cylinder-units 10. The individual piston-cylinder-units 10 are connected to each other or to a frame by means of the fastening means 120.

In addition to the illustrated design with several piston-cylinder-units 10 it is also possible to use only one piston-cylinder-unit. Thus to be able to swing and simultaneously actuate many half scoops 110, it is necessary in this case that the pistons 20 exhibit four radially extending extension pieces 22, which are connected so as to swivel by means of coupling rods 40 to the appropriate half scoops 110.

In addition to the illustrated embodiment of FIG. 10 that exhibits four piston-cylinder-units 10, it is also possible to provide, as necessary, more or fewer piston-cylinder-units or half scoops.

The invention being thus described, it will be obvious that the same may be varied in many ways. Such variations are not to be regarded as a departure from the spirit and scope of the invention, and all such modifications as would be recognized by one skilled in the art are intended to be included within the scope of the following claims.

What is claimed is:

1. Hydraulic piston-cylinder-unit for a slewing drive to swing a working tool comprising at least one piston which is slidable in a twin-plunger cylinder and is operatively connected to a coupling rod such that the working tool is swung by a movement of the piston, said twin-plunger cylinder connected to at least one of the working tool and a carrier of the slewing drive, and including chambers at both faces of said piston which are pressure-driven and exhibit different diameters.

2. The hydraulic piston-cylinder-unit as claimed in claim 1, and further including an extension piece which projects beyond the cylinder and to which the coupling rod is attached so as to swing.

3. The hydraulic piston-cylinder-unit as claimed in claim 2, wherein said cylinder includes at least one slotted recess through which the extension piece extends, whereby the extension piece exhibits a cover element for covering the slotted recess.

4. The hydraulic piston-cylinder-unit as claimed in claim 2, wherein the extension piece is screwed to the piston.

5. The hydraulic piston-cylinder-unit as claimed in claim 2, wherein each opposite side of the piston exhibits an extension piece which extends radially from said piston.

6. The hydraulic piston-cylinder-unit as claimed in claim 3, wherein the cylinder includes two end members and at least one center member which is disconnectably connected to the end members.

7. The hydraulic piston-cylinder-unit as claimed in claim 6, wherein the center member exhibits the slotted recess to pass through the extension piece of the piston.

8. The hydraulic piston-cylinder-unit as claimed in claim 6, wherein the center member exhibits a strap by means of which a slewing member is mounted in the carrier of the slewing member so as to swivel.

9. The hydraulic piston-cylinder-unit as claimed in claim 2, wherein the extension piece is welded to the piston.

10. The hydraulic piston-cylinder-unit as claimed in claim 1, wherein the piston exhibits a cross borehole.

11. The hydraulic piston-cylinder-unit as claimed in claim 1, further including a the fastening element which comprises straps that have a borehole to mount the cylinder.

12. A hydraulic piston-cylinder-unit for a slewing drive to swing a working tool, comprising at least one piston which is slidable in a cylinder and is connected to a coupling rod such that the working tool is swung by a movement of the piston, each opposite side of said piston having an extension piece to which said coupling rod is attached so as to swing, said extension pieces extending radially from said piston and projecting beyond the cylinder, said cylinder including a fastening element for connecting said cylinder to at least one of the working tool and a carrier of the slewing drive.

13. The hydraulic piston-cylinder-unit as claimed in claim 12, wherein the cylinder is a twin-plunger cylinder having chambers of different diameters.

14. The hydraulic piston-cylinder-unit as claimed in claim 12, wherein the fastening element of the cylinder comprises straps which have a borehole to mount the cylinder.

15. A hydraulic piston-cylinder-unit for a slewing drive to swing a working tool, comprising at least one piston which is slidable in a cylinder and is connected to a coupling rod such that the working tool is swung by a movement of the piston, said cylinder including two end members and at least one center member which is disconnectably connected to said end members, and a fastening element for connecting said cylinder to at least one of the working tool and a carrier of the slewing drive.

16. The hydraulic piston-cylinder-unit as claimed in claim 15, and further including an extension piece projecting beyond the cylinder and to which the coupling rod is attached so as to swing, said cylinder including at least one slotted recess through which the extension piece extends, and said center member exhibiting the slotted recess.

17. The hydraulic piston-cylinder-unit as claimed in claim 16, wherein the extension piece is connected to the piston by at least one of screwing and welding.

18. The hydraulic piston-cylinder-unit as claimed in claim 15, wherein the center member exhibits a strap by means of which a slewing member is mounted in the carrier of the slewing member so as to swivel.

19. The hydraulic piston-cylinder-unit as claimed in claim 15, wherein the cylinder is a twin-plunger cylinder having chambers of different diameters.

20. The hydraulic piston-cylinder-unit as claimed in claim 15, wherein the fastening element of the cylinder comprises straps which have a borehole to mount the cylinder.

* * * * *

UNITED STATES PATENT AND TRADEMARK OFFICE

CERTIFICATE OF CORRECTION

PATENT NO. : 6,260,470 B1
DATED : July 17, 2001
INVENTOR(S) : Mieger

It is certified that error appears in the above-identified patent and that said Letters Patent is hereby corrected as shown below:

Column 4,
Line 9, insert -- Fig. 1B is -- after the word "and".

Column 6,
Line 56, correct Claim 11 by deleting the word "the".

Signed and Sealed this

Fifth Day of November, 2002

*Attest:*

*Attesting Officer*

JAMES E. ROGAN
*Director of the United States Patent and Trademark Office*